US005471199A

United States Patent [19]

Yuan

[11] Patent Number: 5,471,199

[45] Date of Patent: Nov. 28, 1995

[54] PERSONAL LOCKABLE ALARM DEVICE

[76] Inventor: Zhiping Yuan, 215 Sand Beach Blvd. Apt. 2002, Shreveport, La. 71105

[21] Appl. No.: 253,901

[22] Filed: Jun. 3, 1994

[51] Int. Cl.[6] ..... G08B 15/00

[52] U.S. Cl. ..... 340/574; 340/693

[58] Field of Search ..... 340/574, 693

[56] References Cited

U.S. PATENT DOCUMENTS

| | | | |
|---|---|---|---|
| 3,528,664 | 9/1970 | Gunn, Jr. | 273/183.1 |
| 3,791,375 | 2/1974 | Pfeiffer | 116/67 R |
| 4,223,804 | 9/1980 | Morris et al. | 222/3 |
| 4,520,351 | 5/1985 | Altman et al. | 340/574 |
| 4,665,389 | 5/1987 | Clendening | 340/574 |
| 4,694,284 | 9/1987 | Leveille et al. | 340/574 |
| 4,759,309 | 7/1988 | Zediker | 116/67 R |
| 5,235,322 | 8/1993 | Obysovsky et al. | 340/574 |

*Primary Examiner*—Glen Swann

[57] ABSTRACT

A personal lockable alarm device may be lockably attached to either an ankle or a wrist to produce a loud noise when activated, and may not be deactivated or removed from the ankle or wrist until a code is entered into a locking mechanism of the device.

12 Claims, 2 Drawing Sheets

FIG. 2
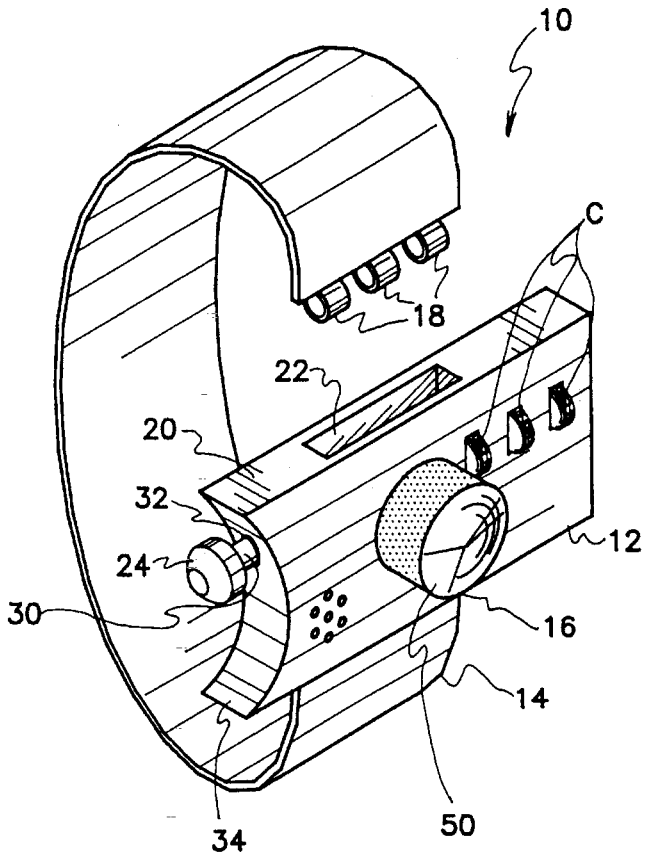
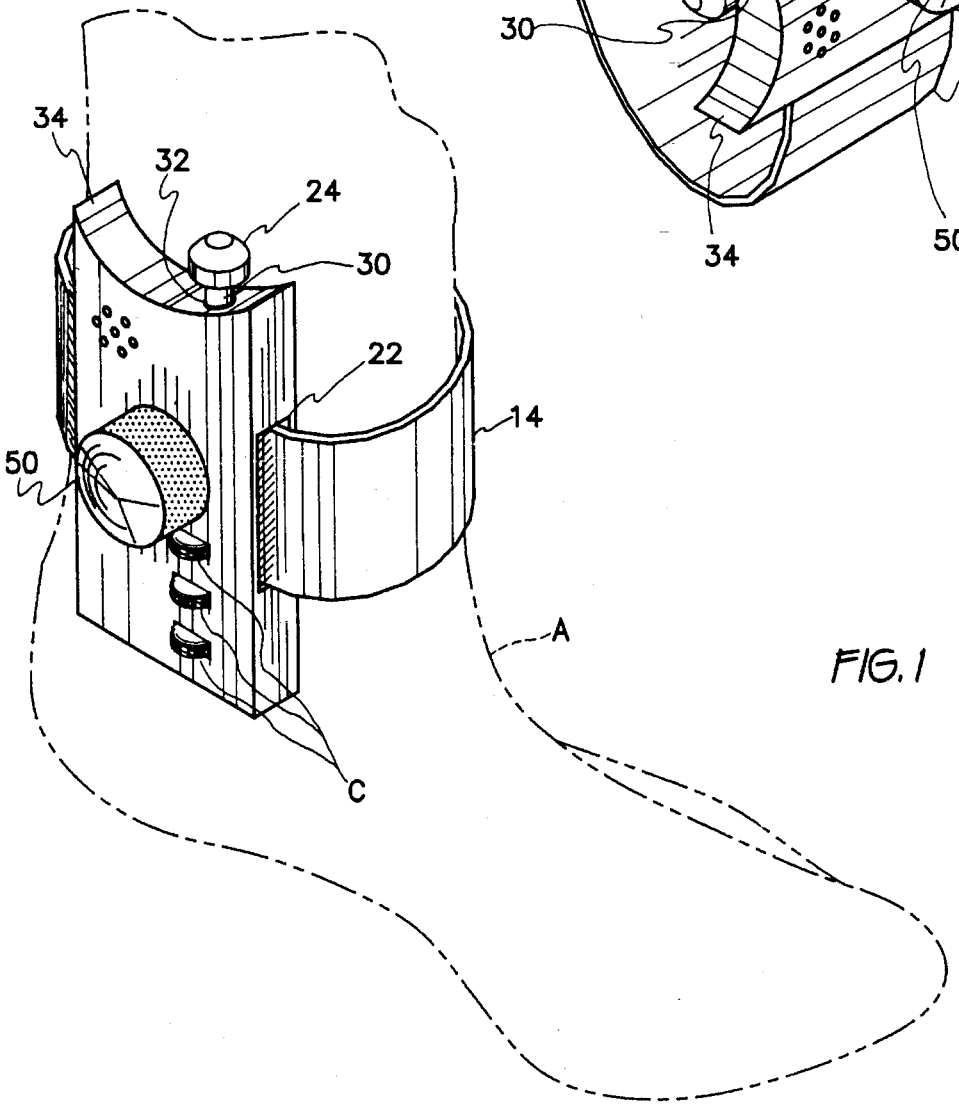
FIG. 1

PERSONAL LOCKABLE ALARM DEVICE

BACKGROUND OF THE INVENTION

FIELD OF THE INVENTION

The present invention relates to a personal lockable alarm device which may be lockably attached to either an ankle or a wrist to produce a loud noise when activated, and may not be deactivated or removed from the ankle or wrist until a code is entered into a locking mechanism of the device.

DESCRIPTION OF THE PRIOR ART

The present invention relates to a personal lockable alarm device which is lockably attached to either a wrist or an ankle. This alarm device is locked by means of wheels which, when the alarm device is attached to either a wrist or an ankle are set to a position which makes the personal alarm device unable to be removed from the wrist or ankle. After the personal alarm device has been activated, the alarm is unable to be disarmed and the personal alarm device is unable to be removed from the wrist or ankle until the wheels have been set to a preset position. Once the wheels have been set to the preset code, the personal alarm device is able to be removed from the wrist or ankle. In addition, this personal alarm device is reusable since, after the device has been removed, the device is reset by merely replacing the device on a wrist or an ankle.

U.S. Pat. No. 4,759,309, issued Jul. 26, 1988 to Victor C. Zediker, discloses a Passive Personal Alarm Device which is filled with either a passive air, gas aerosol or pressurized fluid activated personal self-protection screech alarm device that is armed prior to the person utilizing it entering into a potentially dangerous area or situation. The primary feature of this device is that no action is required of the person carrying it in the event of an attack other than the natural inclination to release one's grip on the device. Releasing of the grip on the aerosol can and dropping the device then activates an irrevocable screech alarm. This device plays to the psychological implications of attack in that if active, overt action is taken by the victim of the attack, the attacker oftentimes becomes more violent. With this device, the natural inclination to show fright and drop whatever one is carrying serves to activate the alarm. More particularly, when the device is dropped from the hand, a spring loaded lever flies up and away from the can and becomes separated. That in turn releases a spring loaded fly-away plug valve allowing the propellant to escape and sound the alarm signalling portion of the device. However, this device does not include a code mechanism to prevent the device from being removed from the victim or any means for this particular device to be reusable.

U.S. Pat. No. 4,223,804, issued Sep. 23, 1980 to Bob H. Morris et al., discloses a Personal Defense Device which combines a flashlight with a renewable, interchangeable cylinder containing compressed gas which may be used to generate a noise, to disperse dye and/or an odoriferous spray. The compressed gas may be stored in a canister which may take the form of a spray can having the typical articulated dispensing nozzle which is then received in an articulated throat assembly displaced to release the contents by a pivoted trigger engaging a pivoted arm assembly. In the normal state the trigger is aligned over the exit opening of the throat, thus protecting the dispensing nozzle from inadvertent release, and when released the trigger aligns to engage the arm. However, this device has no means to prevent the device from being taken from the victim prior to use and has a limited usefulness since the canister has to be replaced after the gas, aerosol gas or fluid has been used up.

U.S. Pat. No. 3,791,375, issued Feb. 12, 1974 to Erich A. Pfeiffer, discloses a Device For Sensing And Warning Of Excessive Ambulation Force provides an audible warning of excessive force being placed on a lower extremity during ambulation. This device is placed on an ankle with a sensor attached to the bottom of a sole of a respective foot. However, there is no motivation for using this device as a deterrent of an attack.

U.S. Pat. No. 3,528,664, issued Sep. 15, 1970 to George Gunn, Jr., discloses a Golfer's Stroke Timing Aid and follow through indicating device to be worn on a golfer's wrist. There is no motivation for using this device as an attack deterrent device.

None of the above inventions and patents, taken either singly or in combination, is seen to describe the instant invention as claimed.

SUMMARY OF THE INVENTION

The device of the present invention includes an alarm mechanism which produces a loud noise when activated. Once attached to the user, a code must be entered into the locking mechanism of the device before the device may be removed from the person using the device. Further, once the device is activated to produce the loud noise, the device may not be deactivated until the locking mechanism is removed from the person using the device.

Accordingly, it is a principal object of the invention to personal alarm device which may not be removed from the person unless a code is provided by the user.

It is another object of the invention to prevent the device from being deactivated once activated until the code is entered.

It is a further object of the invention to a personal alarm device which is easily activated by pressing an alarm button down.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 1 is a perspective view of the device unlocked.

FIG. 2 is a perspective view of the device locked around the ankle of a user.

Similar reference characters denote corresponding features consistently throughout the attached drawings.

DETAILED DESCRIPTION OF THE PREFERRED EMBODIMENT

Figure 3:
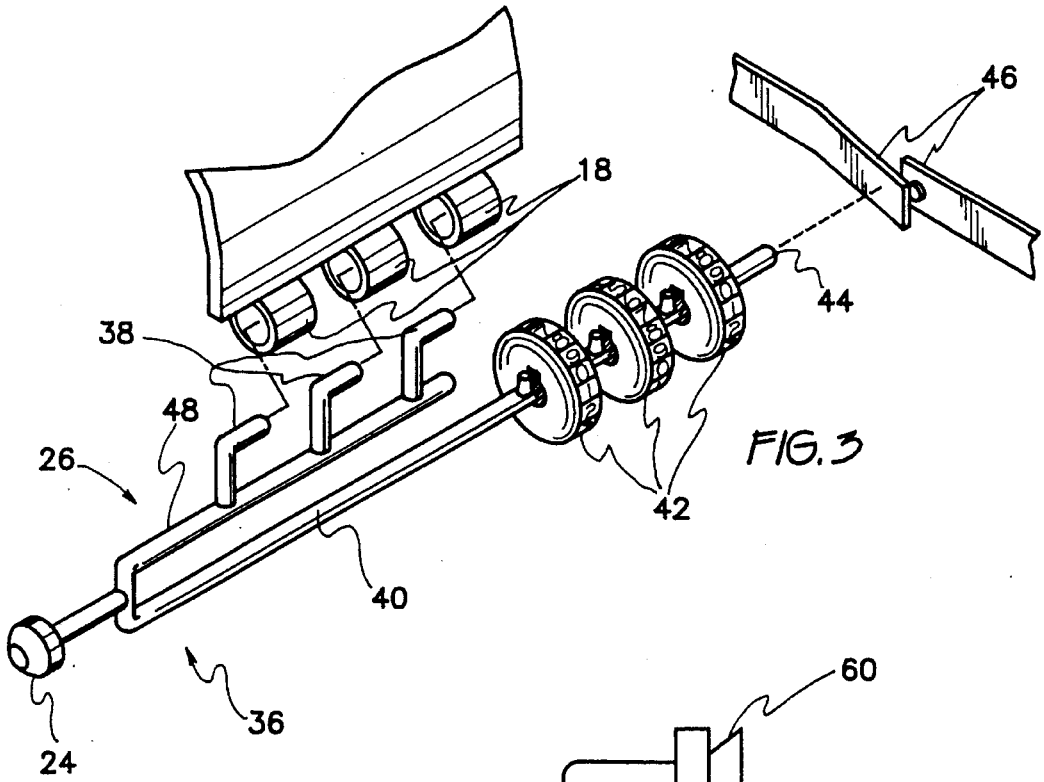
FIG. 3 is a partial exploded perspective view of the locking mechanism of the device.
Figure 4:
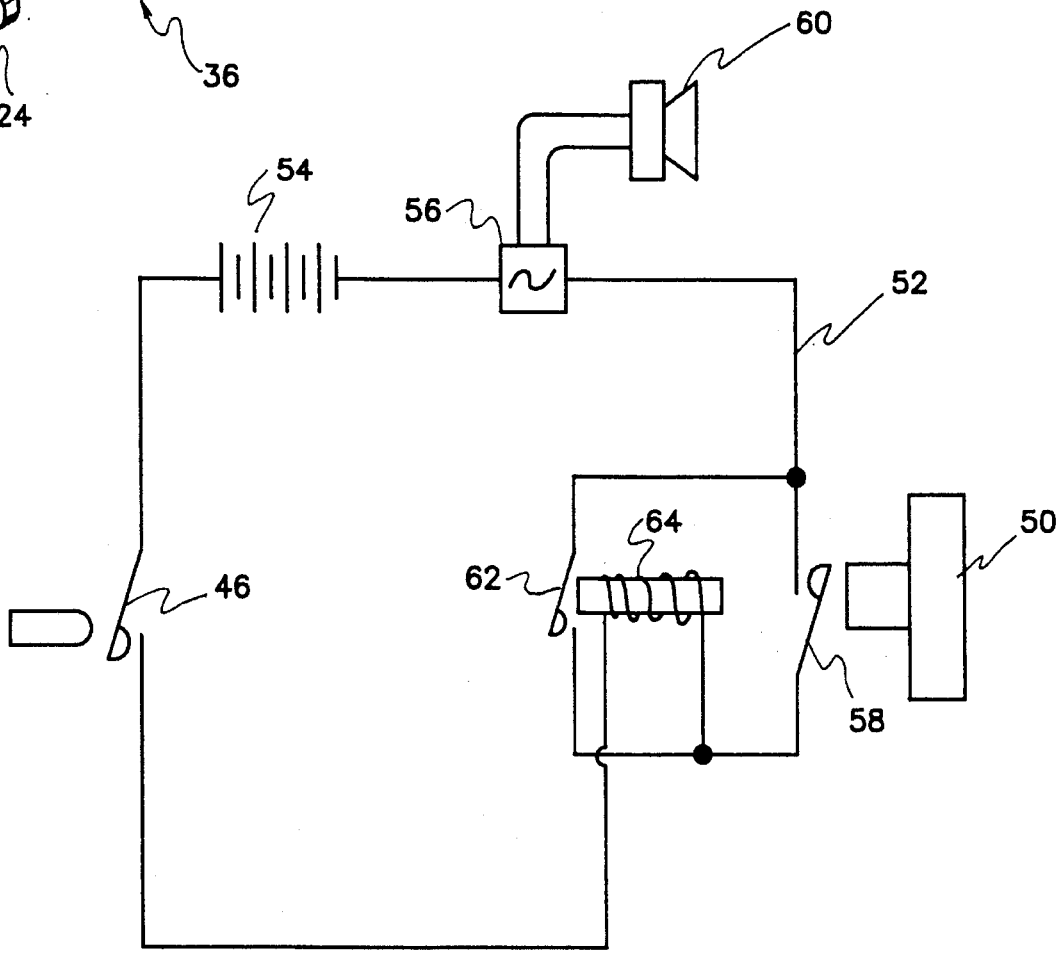
FIG. 4 is a schematic diagram of the electrical circuitry of the device.

As illustrated in FIGS. 1 and 2, personal lockable alarm device 10 of the present invention may be placed on the person of a user of the device 10 in a secured fashion so as to prevent the device 10 from coming off of the person. For example, the device 10 may be secured about the ankle A of a user of the device 10. The alarm device 10 includes an outer housing 12 with a band 14 to attach the device 10. The band 14 is attached to the housing 12 at one end 16 thereof and includes fastening loops 18 attached to the other end, represented by surface 20. These fastening loops 18 are inserted within a receptacle 22 of the outer housing 12 so as to secure the device 10 to the user. To fasten the device 10 to the ankle A as illustrated in FIG. 1, the device 10 is placed near the ankle A of one foot, for example the right foot. The band 14 is then placed about the ankle A with the second end 20 of the band 14 being inserted into the receptacle 22. The flanged portion 24 of a locking shaft 26 (see FIG. 3) is pressed down by the user to secure the device 10 about the ankle A. Should the user wish to remove the device 10, the user simply pulls up on the flanged portion 24.

As illustrated in FIG. 3, a locking mechanism includes the locking shaft 26 having the flanged portion 24 at the top thereof. The locking shaft 26 is a forked shaft having a stem portion 30 which fits through the hole 32 of the top portion 34 of the outer housing 12 so as to extend out of the housing 12 as illustrated in FIGS. 1 and 2. With the flanged portion 24 pulled up to its maximum upward position, a forking portion 36 of the shaft 26 engages the top portion 34 of the outer housing 12 and can not exit the hole 32. A first portion 48 of the locking shaft includes fingers 38 for engaging the fastening loops 18 within the receptacle as the locking shaft 26 is pushed down.

As illustrated in FIG. 3, a second portion 40 of the locking shaft 26 cooperates with three coded wheels 42, each wheel 42 must be aligned with a particular code C visible to the user before the locking shaft 26 may move. Code C comprises indicia disposed upon the wheels 42 in predetermined locations. When the indicia of the three wheels are aligned in the predetermined locations, locking shaft 26 can move. A tip 44 of the second portion 40 of the locking shaft 26 engages an alarm enabling switch 46 so as to enable the alarm device 10 as described below. Should the user encounter an assailant or robber, the user simply uses the left foot to push an activation button 50 for a short period of time. This activates the device 10 to produce a loud tone. In order to deactivate the device 10, the code C has to be entered through the use of the plurality of locking wheels 42 which engage the locking shaft 26. The locking shaft is then pulled up so as to disengage the tip portion 44 from the alarm enabling switch 46 so as to deactivate the alarm device as described below.

A conduction path as established by a wire 52 having a battery 54, an alarm signal generator 56, activation switch 58, and the alarm enabling switch 46 located therein, provides power to the alarm signal generator 56 as long as the conduction path is unbroken. The alarm signal generator 56 is connected to a speaker 60 so as to generate a loud tone when activated. A relay switch 62 is located in the conduction path parallel with the activation switch 58. A relay coil 64 is located in series with the activation switch 58 and closes the relay switch 62 when said conduction path is not broken and current flows therethrough.

With the alarm enabling switch 46 closed, once the alarm activation button 50 is pressed so as to press down on the alarm activation switch 58, current flows within the unbroken conduction path, activating the relay coil 64 so as to maintain conduction path unbroken even after the user releases the alarm activation button 50.

It is to be understood that the present invention is not limited to the sole embodiment described above, but encompasses any and all embodiments within the scope of the following claims.

I claim:

1. A personal lockable alarm device comprising:

an outer housing;

a band having a first end attached to said outer housing and a second end opposite said first end;

a receptacle located on said outer housing for receiving said second end of said band;

locking means for selectively engaging said second end of said band within said receptacle, thereby maintaining said second end of said band therein and, alternatively, for releasing said second end of said strap therefrom when said locking means is located in an unlocked position;

alarm signal generation means located within said outer housing for producing an alarm signal when activated;

a manual alarm switch;

an alarm enabling switch located within said outer housing selectively adjustable between an enabling position for activating said alarm signal generation means upon the actuation of said manual alarm switch and a disabling position for deactivating said alarm signal generation means;

lock position detection means for detecting when said locking means is located in said locked position and, alternatively, in said unlocked position; and means for deactivating said alarm signal generation means by said alarm enablings when said locking means is located in said unlocked position as detected by said lock position detection means.

2. A personal lockable alarm device as claimed in claim 1, further comprising a portable battery located within said housing for supplying a main electrical current within a main conduction path.

3. A personal lockable alarm device as claimed in claim 2, wherein said alarm signal generation means, said alarm enabling switch, and said manual alarm switch are located in series within said main conduction path, and wherein said signal generation means is activated when said main conduction path is closed and said alarm enabling switch and said manual alarm switch are biased open so as to open said main conduction path.

4. A personal lockable alarm device as claimed in claim 3, further comprising a shaft for engaging said alarm enabling switch when said locking means is located in said locked position so as to hold said alarm enabling switch closed in said enabling position, and, alternatively, for disengaging said alarm switch when said locking mechanism is located in said unlocked position so as to allow said alarm enabling switch to remain open in said disabling position.

5. A personal lockable alarm device as claimed in claim 3, further comprising a relay switch located within said main conduction path in parallel with said manual alarm switch, and a relay coil located within said main conduction path in series with said manual switch for closing said relay switch when activated when said conduction path is closed.

6. A personal lockable alarm device comprising:

an outer housing;

a band having a first end attached to said outer housing and a second end opposite said first end;

a receptacle located on said outer housing for receiving said second end of said band;

a locking shaft having a first inner portion contained within said outer housing, said first inner portion of said locking shaft including means for selectively engaging said second end of said band within said receptacle when said first inner portion of said locking shaft is located in a locked position, and releasing said second end of said band located from said receptacle when said first inner portion of said locking shaft is located in an unlocked position;

an outer portion of said locking shaft extending out from said outer housing, said outer portion thereof selectively placed in a raised position having a maximum amount of said outer portion of said locking shaft extending out from said outer housing, or a lowered position and having a minimum amount of said outer portion of said locking shaft extending out from said outer housing, said first inner portion of said locking shaft being placed in said locked position when said outer portion thereof is located in said lowered position and in said unlocked position when said outer portion thereof is located in said raised position;

alarm signal generation means located within said outer housing for producing an alarm signal when activated;

a manual alarm switch;

an alarm enabling switch located within said outer housing selectively adjustable between an enabling position for activating said alarm signal generation means when said manual switch closed and a disabling position for deactivating said alarm signal generation means; and lock position detection means for detecting when first inner portion of said locking shaft is located in said locked position and, alternatively, in said unlocked position; and means for deactivating said alarm signal generation means when said first inner portion of said locking shaft is located in said unlocked position as detected by said lock position detection means.

7. A personal lockable alarm device as claimed in claim 6, further comprising a portable battery located within said housing for supplying a main electrical current within a main conduction path.

8. A personal lockable alarm device as claimed in claim 7, wherein said alarm signal generation means, said alarm enabling switch, and said manual alarm switch are located in series within said main conduction path, and wherein said signal generation means is activated when said main conduction path is opened and said alarm enabling switch and said manual alarm switch are biased open so as to open said main conduction path.

9. A personal lockable alarm device as claimed in claim 8, further comprising a relay switch located within said main conduction path in parallel with said manual alarm switch, and a relay coil located within said main conduction path in series with said manual switch, for closing said relay switch when activated when said main conduction path is opened.

10. A personal lockable alarm device as claimed in claim 9, wherein said manual alarm switch includes an upwardly biased pushbutton located on said outer housing and a stem located on said pushbutton and extending within said outer housing in close proximity to said alarm switch, said stem engaging said alarm switch so as to close said alarm switch when said pushbutton is depressed a predetermined amount.

11. A personal lockable alarm device as claimed in claim 10, further comprising a second inner portion of said locking shaft located within said inner housing, said second inner portion of said locking shaft including a tip portion thereof comprising said lock position detection means for engaging said alarm enabling switch so as to maintain said alarm enabling switch in a closed position when said outer portion of said locking shaft is placed in said lowered position.

12. A personal lockable alarm device as claimed in claim 11, further comprising a user engagable coded locking mechanism located on said outer housing having an immobilizing position for preventing a user from moving said outer portion of said locking shaft from said raised position to said lowered position if located in said raised position when said engagable locking mechanism was last positioned in said immobilizing position, and alternatively, for preventing a user from moving said outer portion of said locking shaft from said lowered position to said raised position if located in said lowered position when said engagable locking mechanism was last position in said immobilizing position, said coded locking mechanism further including a disengaged position for allowing a user to move said outer portion of said locking shaft from said raised position to said lowered position and said lowered position to said raised position upon the entering of a code by said user.

* * * * *